US012013165B2

(12) United States Patent
Lee et al.

(10) Patent No.: US 12,013,165 B2
(45) Date of Patent: Jun. 18, 2024

(54) REFRIGERATOR AND METHOD FOR CONTROLLING SAME

(71) Applicant: LG ELECTRONICS INC., Seoul (KR)

(72) Inventors: Donghoon Lee, Seoul (KR); Donghoon Lee, Seoul (KR); Wookyong Lee, Seoul (KR); Seungseob Yeom, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/282,283

(22) PCT Filed: Oct. 1, 2019

(86) PCT No.: PCT/KR2019/012876

§ 371 (c)(1),
(2) Date: Apr. 1, 2021

(87) PCT Pub. No.: WO2020/071763

PCT Pub. Date: Apr. 9, 2020

(65) Prior Publication Data

US 2021/0389037 A1 Dec. 16, 2021

(30) Foreign Application Priority Data

Oct. 2, 2018 (KR) ..... 10-2018-0117785
Oct. 2, 2018 (KR) ..... 10-2018-0117805
(Continued)

(51) Int. Cl.
*F25C 1/24* (2018.01)
*F25C 1/18* (2006.01)
(Continued)

(52) U.S. Cl.
CPC ..... *F25C 1/24* (2013.01); *F25C 5/08* (2013.01); *F25D 29/00* (2013.01); *F25C 1/18* (2013.01);
(Continued)

(58) Field of Classification Search
CPC ..... F25C 1/24; F25C 5/08; F25C 1/18; F25C 2400/06; F25C 2400/10; F25C 2700/12
See application file for complete search history.

(56) References Cited

U.S. PATENT DOCUMENTS 4,910,974 A 3/1990 Hara
5,617,728 A 4/1997 Kim et al.
(Continued)

FOREIGN PATENT DOCUMENTS

EP 2 549 208 A2 1/2013
EP 2 578 969 A2 4/2013
(Continued)

OTHER PUBLICATIONS

Translated_Shuzo (Year: 1993).*
(Continued)

*Primary Examiner* — Elizabeth J Martin
*Assistant Examiner* — Samba Gaye
(74) *Attorney, Agent, or Firm* — KED & Associates LLP

(57) ABSTRACT

A refrigerator includes a first tray forming a part of an ice-making cell in which water undergoes a phase change to ice due to the cool air, a second tray forming another part of the ice-making cell and in contact with the first tray during an ice-making process, a water supply to supply water to the ice-making cell, a heater which is adjacent to at least one of the first tray or the second tray; and a controller to control the heater. The second tray is moveable with respect to the first tray, and the controller is configured to control a movement of the second tray.

19 Claims, 14 Drawing Sheets

(30) Foreign Application Priority Data

| | | |
|---|---|---|
| Oct. 2, 2018 | (KR) | 10-2018-0117819 |
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081717 |

(51) Int. Cl.
*F25C 5/08* (2006.01)
*F25D 29/00* (2006.01)

(52) U.S. Cl.
CPC ..... *F25C 2400/06* (2013.01); *F25C 2400/10* (2013.01); *F25C 2400/14* (2013.01); *F25C 2600/04* (2013.01); *F25C 2700/12* (2013.01)

(56) References Cited

U.S. PATENT DOCUMENTS

| | | | | |
|---|---|---|---|---|
| 9,151,527 | B2 | 10/2015 | Boarman et al. | |
| 9,335,081 | B2 * | 5/2016 | Son | F25C 5/04 |
| 2004/0025527 | A1 * | 2/2004 | Takahashi | F25C 5/08 62/340 |
| 2005/0217284 | A1 | 10/2005 | An et al. | |
| 2006/0010900 | A1 * | 1/2006 | An | F25C 1/04 62/340 |
| 2006/0168983 | A1 | 8/2006 | Tatsui et al. | |
| 2007/0227164 | A1 | 10/2007 | Ito et al. | |
| 2010/0251733 | A1 * | 10/2010 | Kim | F25C 5/22 700/282 |
| 2011/0048045 | A1 | 3/2011 | An et al. | |
| 2012/0102997 | A1 | 5/2012 | Oh et al. | |
| 2013/0014535 | A1 * | 1/2013 | Son | F25C 1/10 62/340 |
| 2013/0014536 | A1 | 1/2013 | Son et al. | |
| 2013/0081412 | A1 | 4/2013 | Son et al. | |
| 2013/0167563 | A1 | 7/2013 | Lee et al. | |
| 2014/0038060 | A1 | 2/2014 | Abe | |
| 2014/0165598 | A1 * | 6/2014 | Boarman | F25C 1/22 62/347 |
| 2014/0182325 | A1 | 7/2014 | Lee et al. | |
| 2018/0231294 | A1 | 8/2018 | Song et al. | |

FOREIGN PATENT DOCUMENTS

| | | | | |
|---|---|---|---|---|
| EP | 3059526 | | | 8/2016 |
| JP | H 05-203302 | A | | 8/1993 |
| JP | H05203299 | A | * | 8/1993 |
| JP | H0670543 | | | 9/1994 |
| JP | H09-269172 | | | 10/1997 |
| JP | 2005-326035 | | | 11/2005 |
| JP | 2007-120819 | A | | 5/2007 |
| JP | 2007-278548 | A | | 10/2007 |
| JP | 4572833 | B2 | | 11/2010 |
| JP | 2011-064371 | | | 3/2011 |
| JP | 2011-064373 | | | 3/2011 |
| JP | 2011-237077 | A | | 11/2011 |
| JP | 06-070543 | | | 2/2017 |
| KR | 10-1996-0018446 | | | 6/1996 |
| KR | 10-0347040 | | | 8/2002 |
| KR | 10-2005-0069319 | A | | 7/2005 |
| KR | 10-2005-0096336 | A | | 10/2005 |
| KR | 10-2006-0003397 | | | 1/2006 |
| KR | 10-2007-0119271 | | | 12/2007 |
| KR | 10-2009-0079377 | | | 7/2009 |
| KR | 10-2011-0037609 | A | | 4/2011 |
| KR | 10-2012-0003233 | | | 1/2012 |
| KR | 10-2012-0044555 | | | 5/2012 |
| KR | 10-2013-0009332 | | | 1/2013 |
| KR | 10-2013-0009332 | A | | 1/2013 |
| KR | 10-2013-0009521 | A | | 1/2013 |
| KR | 2013009521 | A | * | 1/2013 ..... F25C 1/10 |
| KR | 10-2013-0036421 | | | 4/2013 |
| KR | 10-2014-0088321 | A | | 7/2014 |
| KR | 10-1643635 | B1 | | 7/2016 |
| KR | 10-1850918 | | | 5/2018 |
| KR | 10-2018-0093666 | | | 8/2018 |
| KR | 10-2018-0100752 | | | 9/2018 |

OTHER PUBLICATIONS

Translated_Lee (Year: 2013).*
International Search Report and Written Opinion dated Jan. 28, 2020 issued in Application No. PCT/KR2019/012876.
Extended European Search Report dated Aug. 9, 2022 issued in Application 19868238.7.
Korean Office Action dated May 1, 2023 issued in Application 10-2018-0117785.
Korean Office Action dated May 3, 2023 issued in Application 10-2018-0117805.
Korean Office Action dated May 8, 2023 issued in Application 10-2018-0117819.
Korean Office Action dated May 14, 2023 issued in Application 10-2018-0117821.
Korean Office Action dated May 15, 2023 issued in Application 10-2018-0117822.
Korean Office Action dated Jul. 4, 2023 issued in Application No. 10-2018-0142117.
Korean Notice of Allowance dated Nov. 7, 2023 issued in Application No. 10-2018-0117821.
Korean Notice of Allowance dated Jan. 10, 2024 issued in Application No. 10-2018-0142117.
Korean Notice of Allowance dated Nov. 20, 2023 issued in Application No. 10-2018-0117805.
Korean Office Action dated Mar. 12, 2024, issued in Application No. 10-2018-0117822.

* cited by examiner (a)

(b)

REFRIGERATOR AND METHOD FOR CONTROLLING SAME

CROSS-REFERENCE TO RELATED APPLICATIONS

This application is a U.S. National Stage Application under 35 U.S.C. § 371 of PCT Application No. PCT/KR2019/012876, filed Oct. 1, 2019, which claims priority to Korean Patent Application Nos. 10-2018-0117819, filed Oct. 2, 2018, 10-2018-0117821, filed Oct. 2, 2018, 10-2018-0117822, filed Oct. 2, 2018, 10-2018-0117785, filed Oct. 2, 2018, 10-2018-0117805, filed Oct. 2, 2018, 10-2018-0142117, filed Nov. 16, 2018, and 10-2019-0081717, filed Jul. 6, 2019, whose entire disclosures are hereby incorporated by reference.

TECHNICAL FIELD

The present disclosure relates to a refrigerator and a method for controlling the same.

BACKGROUND ART

In general, refrigerators are home appliances for storing food at a low temperature in a storage space that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray.

The ice maker separates the made ice from the ice tray in a heating manner or twisting manner.

The ice maker through which water is automatically supplied, and the ice automatically separated, for example, opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Patent Registration No. 10-1850918 that is a prior art document.

The ice maker disclosed in the prior art document includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly. The ice maker further includes a water valley part, through which water is transferred from the cell corresponding to a water supply point to the adjacent cells, at portions to which the plurality of cells are adjacent.

In the case of the prior art document, since the water valley part is provided, there is a problem in that ice having a water valley shape is formed together outside spherical ice to deform the shape of the ice.

In addition, in the case of the prior art document, there is a problem that ice are not separated from each other due to the ice formed in the water valley part, and thus, the ice are separated in a state of being attached together to each other.

DISCLOSURE

Technical Problem

Embodiments provide a refrigerator, in which supplied water is uniformly distributed to a plurality of cells, and a method for controlling the same.

Embodiments also provide a refrigerator, in which ice generated in a plurality of cells are separated from the cells in a state of being separated from each other, and a method for controlling the same.

Embodiments also provide a refrigerator, which is capable of preventing water from overflowing out of cells when the water is supplied to the plurality of cells of an ice maker, and a method for controlling the same.

Embodiments also provide a refrigerator capable of generating spherical ice and a method for controlling the same.

Technical Solution

A method for controlling a refrigerator, which comprises a first tray accommodated in a storage chamber, a second tray configured to define an ice making cell together with the first tray, and a heater configured to supply heat to one or more of the first tray and the second tray, includes: supplying water to the ice making cell in a state in which the second tray moves to a water supply position; standing by for a predetermined time at a water supply position after the water supply is completed; allowing the second tray to move from the water supply position to an ice making position in a reverse direction after the predetermined time elapses to perform ice making; turning on the heater when the ice making is completed; and turning off the heater and allowing the second tray to move to an ice separation position in a forward direction.

At the water supply position, a bottom surface of the first tray and a top surface of the second tray may be inclined at a predetermined angle with respect to each other. The predetermined angle may range of 4 degrees to 30 degrees, preferably, 4 degrees to 8 degrees.

The ice making cell may be provided in plurality. Water may be supplied to at least one ice making cell of the plurality of ice making cells, or water may be supplied to the ice making cell, from which the water is distributed to both sides thereof, among the plurality of ice making cells.

The second tray may include a circumferential wall configured to surround a portion of the first tray at the water supply position. At the water supply position, an upper end of the circumferential wall may be disposed higher than a bottom surface of the first tray.

At the water supply position, a height from the bottom surface of the first tray to the upper end of the circumferential wall may be greater than ½ of a height from the bottom surface of the first tray to an upper end of the ice making cell. At the ice making position, an upper end of the circumferential wall may be disposed higher than an upper end of the ice making cell.

The second tray may be connected to the driver to move by the driver.

A refrigerator according to another aspect includes: a storage chamber configured to store food; a cold air supply part configured to supply cold air to the storage chamber; a first tray configured to define a portion of an ice making cell that is a space in which water is phase-changed into ice by the cold air; a second tray configured to define the other portion of the ice making cell, the second tray being in contact with the first tray in an ice making process and spaced apart from the first tray in an ice separation process; a water supply part configured to supply water to the ice making cell; a heater disposed adjacent to at least one of the first tray or the second tray; and a controller configured to control the heater.

The controller may control the ice making cell to stand by for a predetermined time after the water supply to the ice making cell is completed at a water supply position. The controller may control the second tray to move to an ice making position after standing by for the predetermined time so that the cold air supply part supplies the cold air to the ice making cell. The controller may control the second tray to move to an ice separation position in a forward or first direction so as to take ice out of the ice making cell after the ice is completely generated in the ice making cell.

The controller may control the second tray to move from the ice separation position to the water supply position in a reverse or second direction after the separation of the ice is completed.

The second tray may include a circumferential wall configured to surround a portion of the first tray at the water supply position. At the water supply position, an upper end of the circumferential wall may be disposed higher than a bottom surface of the first tray.

At the water supply position, a height from the bottom surface of the first tray to the upper end of the circumferential wall may be greater than ½ of a height from the bottom surface of the first tray to an upper end of the ice making cell. At the ice making position, an upper end of the circumferential wall may be disposed higher than an upper end of the ice making cell.

At the water supply position, a bottom surface of the first tray and a top surface of the second tray may be inclined at a predetermined angle with respect to each other. The predetermined angle may range of 4 degrees to 30 degrees. Preferably, the predetermined angle may range of 4 degrees to 8 degrees.

The controller may control the heater to be turned on in at least partial section while the cold air supply part supplies the cold air so that bubbles dissolved in the water within the ice making cell moves from a portion, at which the ice is generated, toward the water that is in a liquid state to generate transparent ice.

The controller may control one or more of cooling power of the cold air supply part and the heating amount of heater to vary according to a mass per unit height of water in the ice making cell.

Advantageous Effects

According to the proposed invention, the supplied water may be uniformly distributed into the plurality of cells, and the phenomenon, in which the ice are separated in the state of adhering to each other due to the unnecessary ice generated between the ice generated in the plurality of cells when the ice is separated, may be prevented from occurring.

In addition, when the water is supplied to the plurality of cells of the ice maker, the overflowing of the water to the outside of the cells may be prevented from occurring.

In addition, since the tray does not include a separate water valley, the spherical ice may be generated.

MODE FOR INVENTION

Figure 1:
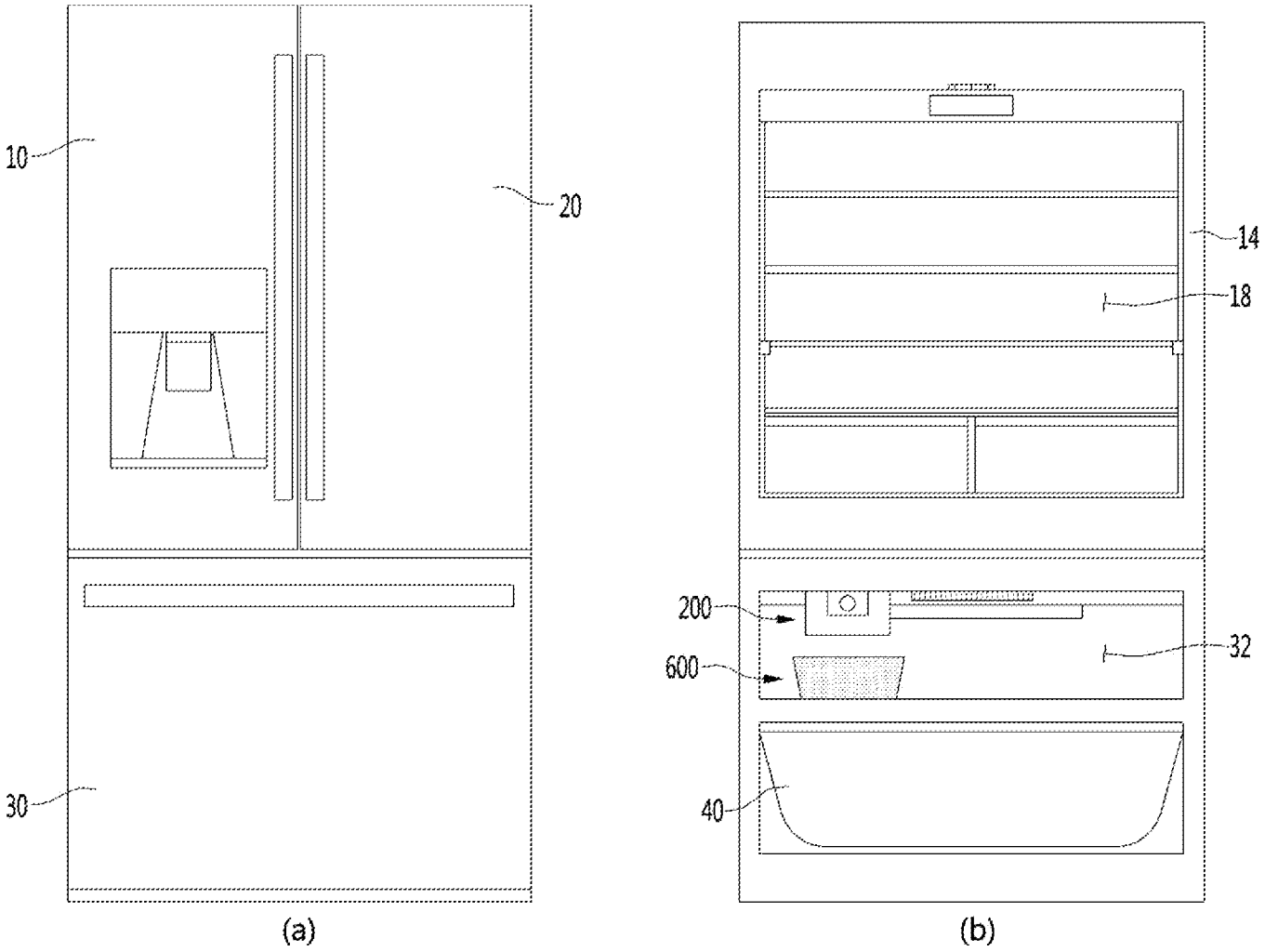
FIG. 1 is a front view of a refrigerator according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 14 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner.

The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 drops to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
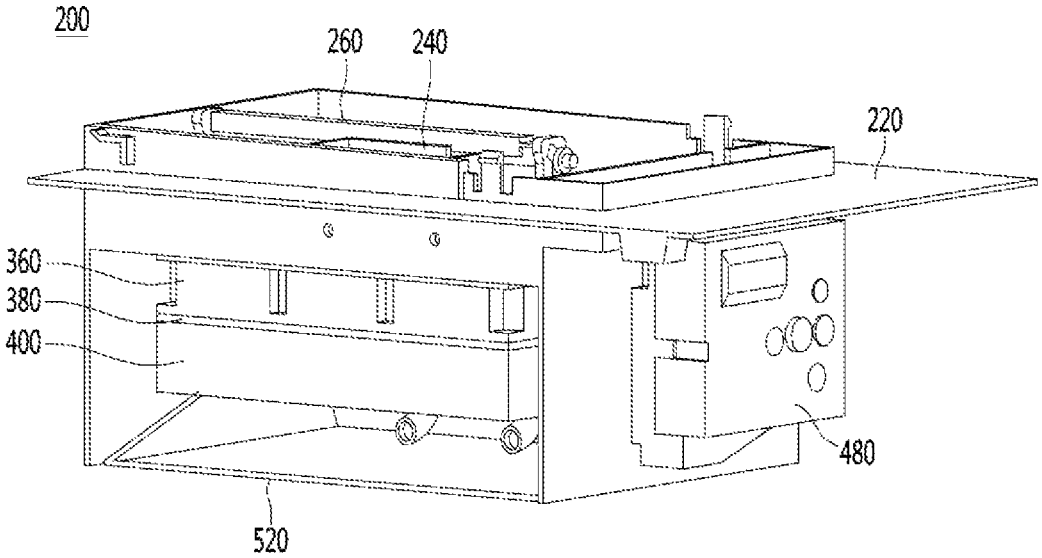
FIG. 2 is a perspective view of an ice maker according to an embodiment of the present invention.
Figure 3:
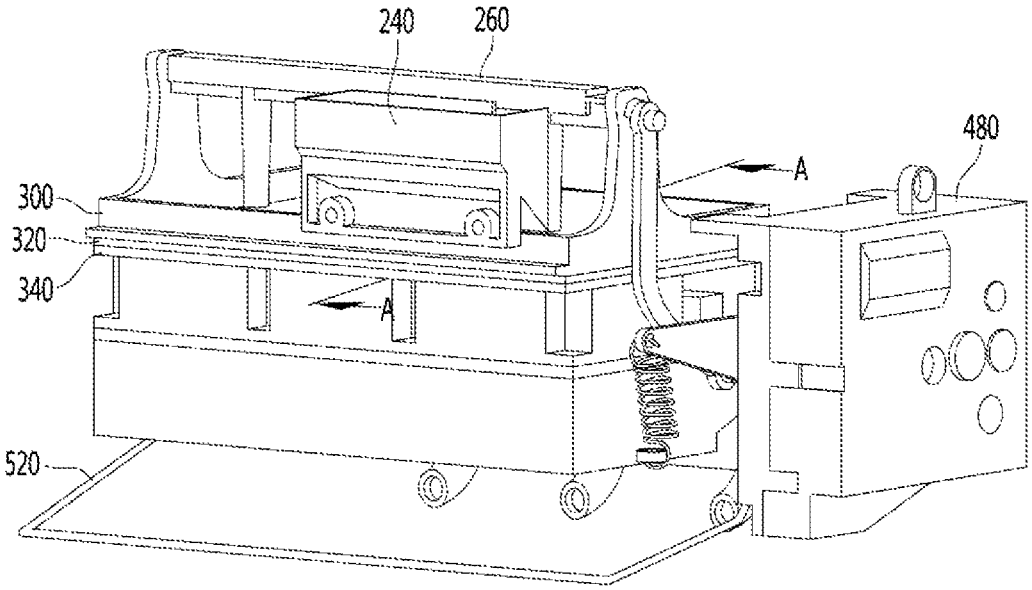
FIG. 3 is a perspective view illustrating a state in which a bracket is removed from the ice maker of FIG. 2.
Figure 4:
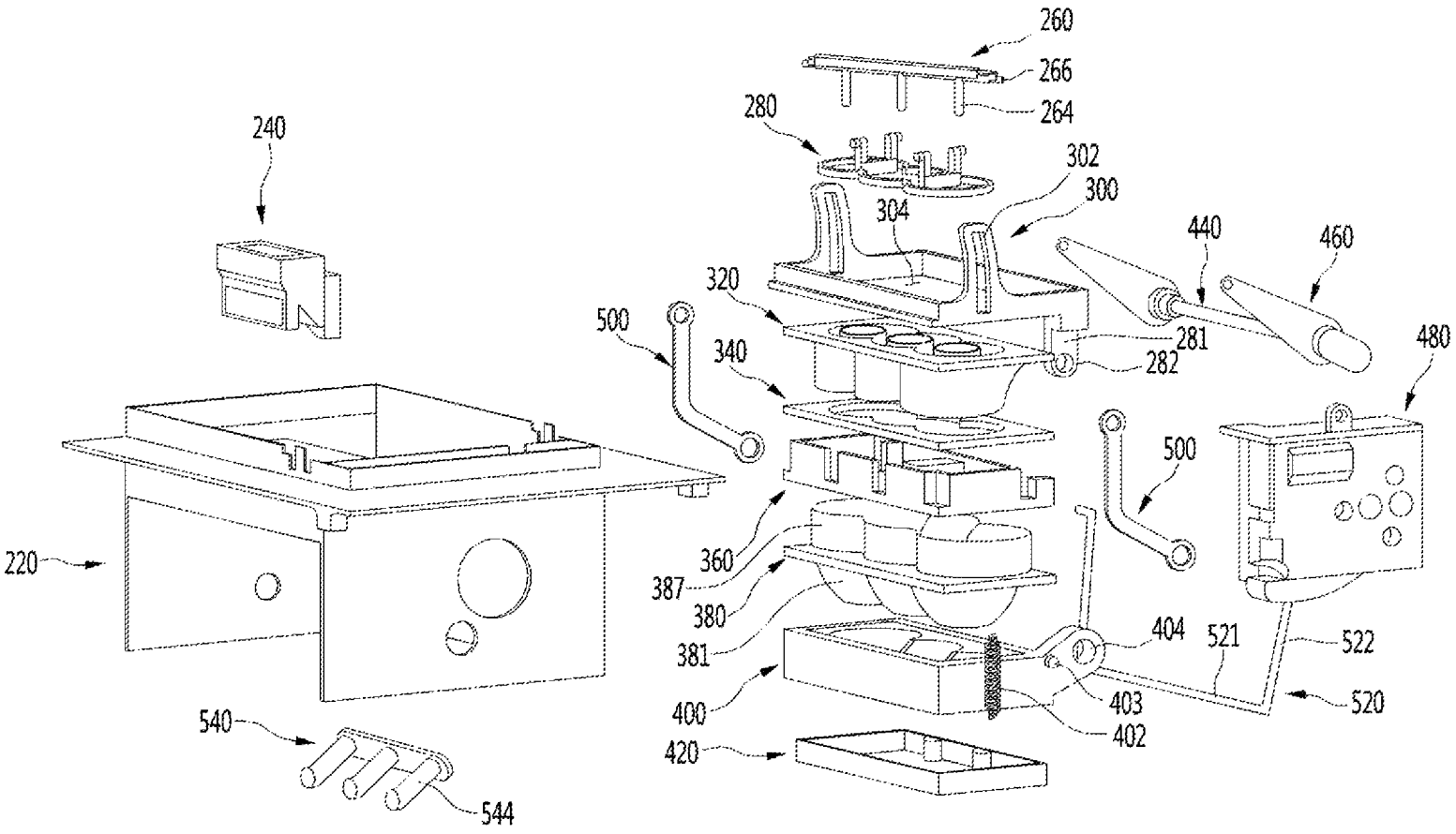
FIG. 4 is an exploded perspective view of the ice maker according to an embodiment of the present invention.

FIG. 2 is a perspective view of the ice maker according to an embodiment, FIG. 3 is a perspective view illustrating a state in which the bracket is removed from the ice maker of FIG. 2, and FIG. 4 is an exploded perspective view of the ice maker according to an embodiment.

Figure 5:
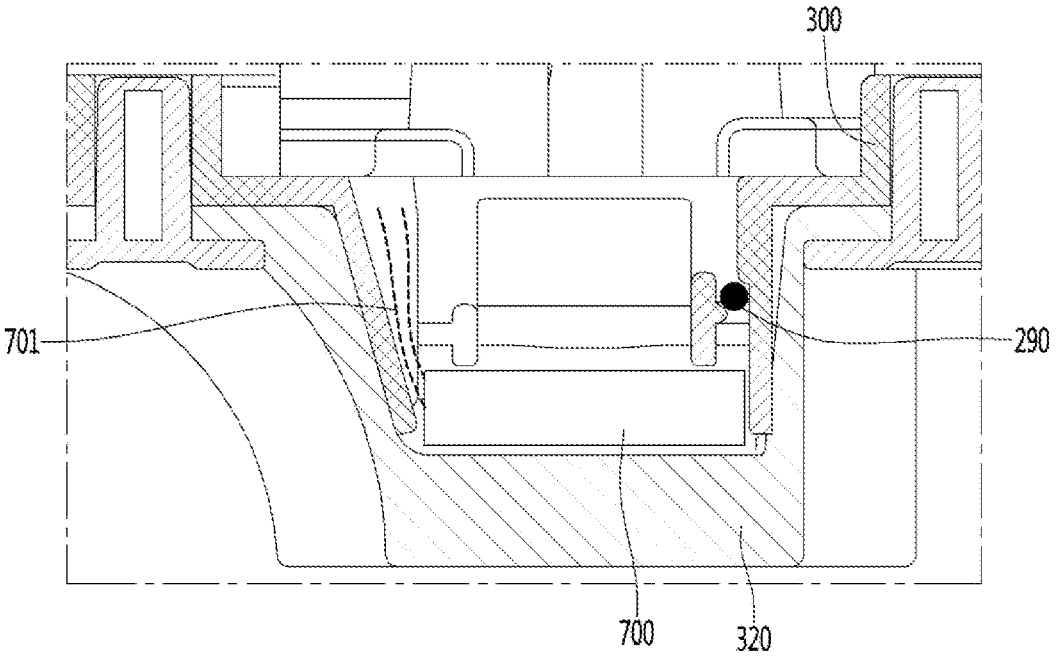
FIG. 5 is a cross-sectional view taken along line A-A of FIG. 3 so as to show a second temperature sensor installed in the ice maker according to an embodiment of the present invention.
Figure 6:
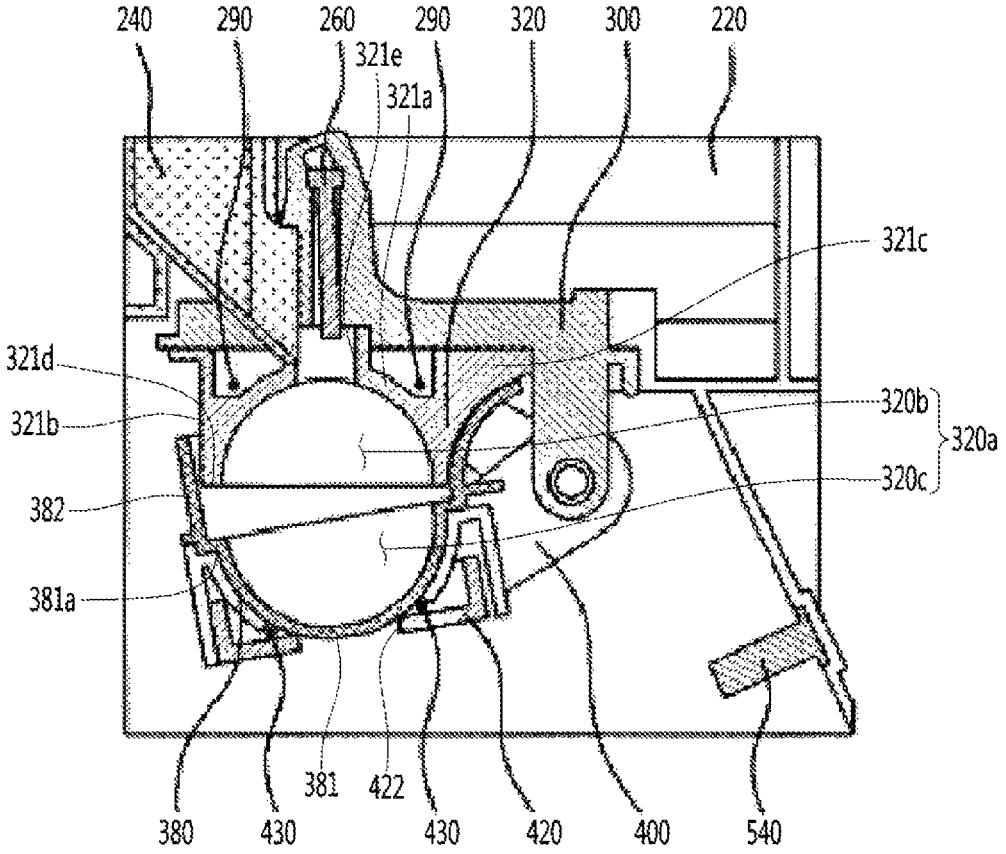
FIG. 6 is a longitudinal cross-sectional view of the ice maker when a second tray is disposed at a water supply position according to an embodiment of the present invention.

FIG. 5 is a cross-sectional view taken along line A-A of FIG. 3 so as to show a second temperature sensor installed in the ice maker according to an embodiment of the present invention, and FIG. 6 is a cross-sectional view taken along line 6-6 of FIG. 2 so as to show the second temperature sensor installed in the ice maker according to an embodiment of the present invention.

FIG. 6 is a longitudinal cross-sectional view of the ice maker when a second tray is disposed at a water supply position according to an embodiment.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. The water supply part or liquid supply 240 may be installed on an upper side of an inner surface of the bracket 220. The water supply part 240 may be provided with an opening in each of an upper side and a lower side to guide water, which is supplied to an upper side of the water supply part 240, to a lower side of the water supply part 240. The upper opening of the water supply part 240 may be greater than the lower opening to limit a discharge range of water guided downward through the water supply part 240. A water supply pipe through which water is supplied may be installed to the upper side of the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air. The ice making cell 320*a* may be formed by a tray.

The tray may include a first tray 320 defining a portion or a first portion of the ice making cell 320*a* and a second tray 380 defining the other portion or a second portion of the ice making cell 320*a*.

Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 are in contact with each other, the complete ice making cell see 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is defined. Accordingly, the first tray 320 may be referred to as an upper tray, and the second tray 380 may be referred to as a lower tray.

A plurality of ice making cells 320*a* may be defined by the first tray 320 and the second tray 380.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. In this case, the first cell 320*b* may be provided in a hemisphere shape or a shape similar to the hemisphere. Also, the second cell 320*c* may be provided in a hemisphere shape or a shape similar to the hemisphere. The ice making cell 320*a* may have a rectangular parallelepiped shape or a polygonal shape.

The ice maker 200 may further include a first tray case 300 coupled to the first tray 320.

For example, the first tray case 300 may be coupled to an upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the second heater case 280. The heater case 280 may be integrally formed with the first tray case 300 or may be separately formed.

The ice separation heater 290 may be disposed at a position adjacent to the first tray 320. For example, the ice separation heater 290 may be a wire-type heater. For example, the ice separation heater 290 may be installed to contact the second tray 320 or may be disposed at a position spaced a predetermined distance from the second tray 320. In some cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320.

The first tray cover 340 may be provided with an opening corresponding to a shape of the ice making cell 320*a* of the first tray 320 and may be coupled to a bottom surface of the first tray 320.

The first tray case 300 may be provided with a guide slot 302 which is inclined at an upper side and vertically extended at a lower side thereof. The guide slot 302 may be provided in a member extending upward from the first tray case 300. A guide protrusion 266 of the first pusher 260 to be described later may be inserted into the guide slot 302. Thus, the guide protrusion 266 may be guided along the guide slot 302.

The first pusher 260 may include at least one extension part 264. For example, the first pusher 260 may include an extension part 264 provided with the same number as the number of ice making cells 320*a*, but is not limited thereto. The extension part 264 may push out the ice disposed in the ice making cell 320*a* during the ice separation process. Accordingly, the extension part 264 may be inserted into the ice making cell 320*a* through the first tray case 300. Therefore, the first tray case 300 may be provided with a hole 304 through which a portion of the first pusher 260 passes.

The guide protrusion 266 of the first pusher 260 may be coupled to the pusher link 500. In this case, the guide protrusion 266 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380.

The second tray case 400 may be disposed at a lower side of the second tray to support the second tray 380. For example, at least a portion of the wall defining a second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray case 360.

The second tray 380 may include a circumferential wall 382 surrounding a portion of the first tray 320 in a state of contacting the first tray 320. The circumferential wall 382 may surround a portion of the first tray 320 at the ice making position. The second tray cover 360 may cover the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an ice making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

Alternatively, at least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. For example, the transparent ice heater 430 may be a wire-type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a E shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220.

The second pusher 540 may include at least one extension part 544. For example, the second pusher 540 may include an extension part 544 provided with the same number as the number of ice making cells 320*a*, but is not limited thereto. The extension part 544 may push the ice disposed in the ice making cell 320*a*. For example, the extension part 544 may pass through the second tray case 400 to contact the second tray 380 defining the ice making cell and then press the contacting second tray 380. Therefore, the second tray case 400 may be provided with a hole 422 through which a portion of the second pusher 540 passes.

The first tray case 300 may be rotatably coupled to the second tray case 400 with respect to the second tray supporter 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicon material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metallic material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

The first tray 320 may be made of a metal material. In this case, since the coupling force or the attaching force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260.

Alternatively, the ice maker 200 may not include the ice separation heater 290 and the first pusher 260.

Although not limited, the first tray 320 may be made of, for example, a silicon material. That is, the first tray 320 and the second tray 380 may be made of the same material.

When the first tray 320 and the second tray 380 are made of the same material, the first tray 320 and the second tray 380 may have different hardness to maintain sealing performance at the contact portion between the first tray 320 and the second tray 380. In this embodiment, since the second tray 380 is pressed by the second pusher 540 to be deformed, the second tray 380 may have hardness less than that of the first tray 320 to facilitate the deformation of the second tray 380.

Referring to FIG. 5, the ice maker 200 may further include a second temperature sensor (or tray temperature sensor) 700 sensing a temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell

320*a*. In this embodiment, the water temperature or the ice temperature of the ice making cell 320*a* may be referred to as an internal temperature of the ice making cell 320*a*. The second temperature sensor 700 may be installed in the first tray case 300.

In this case, the second temperature sensor 700 may contact the first tray 320 or may be spaced a predetermined distance from the first tray 320. Alternatively, the second temperature sensor 700 may be installed in the first tray 320 to contact the first tray 320.

Alternatively, when the second temperature sensor 700 may be disposed to pass through the first tray 320, the temperature of the water or the temperature of the ice of the ice making cell 320*a* may be directly sensed.

A portion of the ice separation heater 290 may be disposed higher than the second temperature sensor 700 and may be spaced apart from the second temperature sensor 700. The wire 701 connected to the second temperature sensor 700 may be guided to an upper side of the first tray case 300.

Referring to FIG. 6, the ice maker 200 according to this embodiment may be designed so that a position of the second tray 380 is different from the water supply position and the ice making position.

For example, the second tray 380 may include a second cell wall 381 defining a second cell 320*c* of the ice making cell 320*a* and a circumferential wall 382 extending along an outer edge of the second cell wall 381.

The second cell wall 381 may include a top surface 381*a*. The top surface 381*a* of the second cell wall 381 may be referred to as a top surface 381*a* of the second tray 380. The top surface 381*a* of the second cell wall 381 may be disposed lower than an upper end of the circumferential wall 382. The upper end wall of the circumferential wall 382 may be in contact with the first tray 320 at the ice making position or may be higher than the communication hole 321*e* of the first tray 320, that is, an upper end of the ice making cell 320*a*.

As a result, when the water is supplied into the ice making cell 320*a* at the water supply position, the supplied water may be prevented from leaking, and also, the water may be prevented from leaking between the first tray 320 and the second tray 380.

Also, when the bottom surface of the first tray 320 and the bottom surface of the second tray 380 are spaced apart from each other at the water supply position, an inner surface of the peripheral wall 382 may be in contact with at least a portion of the first tray 320 to prevent the water within the ice making cell 320*a* from overflowing.

In order for the inner surface of the circumferential wall 382 to be in contact with at least a portion of the first tray 320, the upper end of the circumferential wall 382 may be disposed higher than the bottom surface of the first tray 320 at the water supply position.

For example, the upper end of the circumferential wall 382 may be disposed at a height equal to or higher than a height of a ½ point from the bottom surface of the first cell 320*b*.

The first tray 320 may include a first cell wall 321*a* defining a first cell 320*b* of the ice making cell 320*a*. The first cell wall 321*a* may include a straight portion 321*b* and a curved portion 321*c*. The curved portion 321*c* may have an arc shape having a radius of curvature at the center of the shaft 440. Accordingly, the circumferential wall 382 may also include a straight portion and a curved portion corresponding to the straight portion 321*b* and the curved portion 321*c*.

The first cell wall 321*a* may include a bottom surface 321*d*. The bottom surface 321*b* of the first cell wall 321*a* may be referred to herein as a bottom surface 321*b* of the first tray 320. The bottom surface 321*d* of the first cell wall 321*a* may be in contact with the top surface 381*a* of the second cell wall 381*a*.

For example, at the water supply position as illustrated in FIG. 6, at least portions of the bottom surface 321*d* of the first cell wall 321*a* and the top surface 381*a* of the second cell wall 381 may be spaced apart from each other. FIG. 6 illustrates that the entirety of the bottom surface 321*d* of the first cell wall 321*a* and the top surface 381*a* of the second cell wall 381 are spaced apart from each other. Accordingly, the top surface 381*a* of the second cell wall 381 may be inclined to form a predetermined angle with respect to the bottom surface 321*d* of the first cell wall 321*a*.

Although not limited, the bottom surface 321*d* of the first cell wall 321*a* may be substantially horizontal at the water supply position, and the top surface 381*a* of the second cell wall 381 may be disposed below the first cell wall 321*a* to be inclined with respect to the bottom surface 321*d* of the first cell wall 321*a*.

In the state of FIG. 6, the circumferential wall 382 may surround the first cell wall 321*a*. Also, an upper end of the circumferential wall 382 may be positioned higher than the bottom surface 321*d* of the first cell wall 321*a*.

At the ice making position (see FIG. 10), the top surface 381*a* of the second cell wall 381 may contact at least a portion of the bottom surface 321*d* of the first cell wall 321*a*.

The angle formed between the top surface 381*a* of the second tray 380 and the bottom surface 321*d* of the first tray 320 at the ice making position is less than that between the top surface 382*a* of the second tray and the bottom surface 321*d* of the first tray at the water supply position. At the ice making position, the top surface 381*a* of the second cell wall 381 may contact all of the bottom surface 321*d* of the first cell wall 321*a*. At the ice making position, the top surface 381*a* of the second cell wall 381 and the bottom surface 321*d* of the first cell wall 321*a* may be disposed to be substantially parallel to each other.

In this embodiment, the water supply position of the second tray 380 and the ice making position are different from each other. This is done for uniformly distributing the water to the plurality of ice making cells 320*a* without providing a water passage for the first tray 320 and/or the second tray 380 when the ice maker 200 includes the plurality of ice making cells 320*a*.

If the ice maker 200 includes the plurality of ice making cells 320*a*, when the water passage is provided in the first tray 320 and/or the second tray 380, the water supplied into the ice maker 200 may be distributed to the plurality of ice making cells 320*a* along the water passage.

However, when the water is distributed to the plurality of ice making cells 320*a*, the water also exists in the water passage, and when ice is made in this state, the ice made in the ice making cells 320*a* may be connected by the ice made in the water passage portion.

In this case, there is a possibility that the ice sticks to each other even after the completion of the ice, and even if the ice is separated from each other, some of the plurality of ice includes ice made in a portion of the water passage. Thus, the ice may have a shape different from that of the ice making cell.

However, like this embodiment, when the second tray 380 is spaced apart from the first tray 320 at the water supply position, water dropping to the second tray 380 may be uniformly distributed to the plurality of second cells 320*c* of the second tray 380.

The water supply position may be between the ice separation position and the ice making position, and the second tray 380 may be sufficiently spaced apart from the first tray 320 so that water is distributed to the surrounding second cell 320*c*.

An angle formed between the top surface 381*a* of the second tray 380 and the bottom surface 321*d* of the first tray 320 at the water supply position may be referred to as a water supply angle.

If the water supply angle is too small, the first tray 320 and the second tray 380 are not sufficiently separated from each other, and thus, water may overflow to an upper side of the second tray 320.

If the water supply angle is too large, the first tray 320 and the second tray 380 are too spread, causing a problem of overflowing the supplied water between the first tray 320 and the second tray 380.

Thus, it is necessary to select an appropriate water supply angle, and the appropriate water supply angle may be within 4 degrees to 30 degrees. Also, preferably, the water supply angle may range of 4 degrees to 8 degrees.

The first tray 320 may include a communication hole 321*e*. When the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* of the plurality of communication holes 321*e*.

For example, the water supply part 240 may supply water to the central ice making cell of the plurality of ice making cells 320*a*. In this case, the water supplied through the one communication hole 321*e* drops to the second tray 380 after passing through the first tray 320.

In the water supply process, water may drop into any one of the second cells 320*c* of the plurality of second cells 320*c* of the second tray 380. The water supplied to one of the second cells 320*c* may overflow from the one of the second cells 320*c*.

In this embodiment, since the top surface 381*a* of the second tray 380 is spaced apart from the bottom surface 321*d* of the first tray 320, the water overflowed from any one of the second cells 320*c* may move to the adjacent other second ell 320*c* along the top surface 381*a* of the second tray 380. Therefore, the plurality of second cells 320*c* of the second tray 380 may be filled with water.

Also, in the state in which water supply is completed, a portion of the water supplied may be filled in the second cell 320*c*, and the other portion of the water supplied may be filled in the space between the first tray 320 and the second tray 380.

Figure 9:
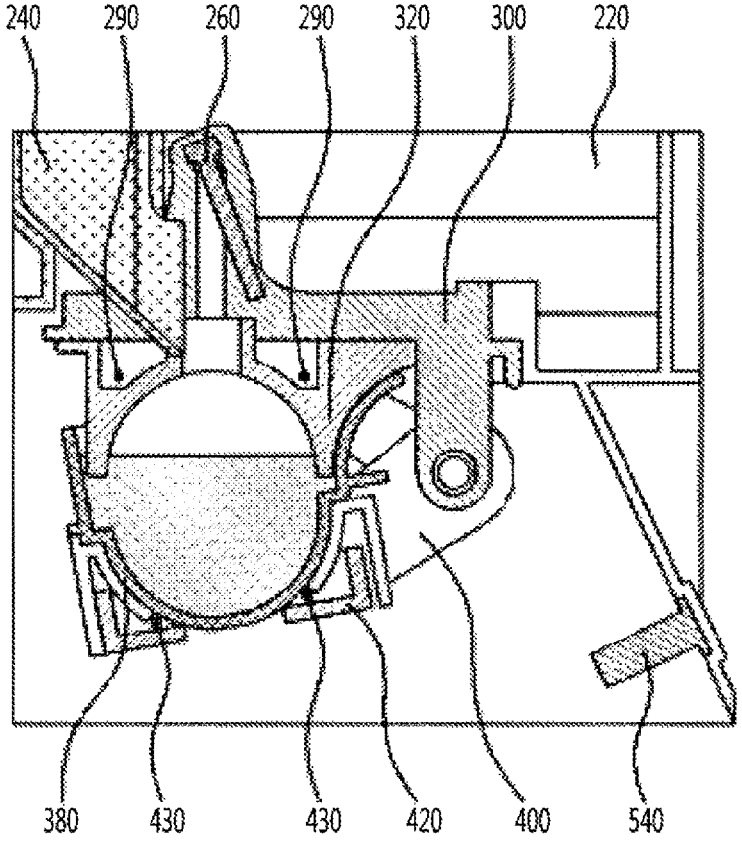
FIG. 9 is a view illustrating a state in which supply of water is completed at a water supply position.

At the water supply position, according to a volume of the ice making cell 320*a*, the water when the water supply is completed may be disposed only in the space between the first tray 320 and the second tray 380 or may also be disposed in the space between the second tray 380 and the first tray 320 (see FIG. 9).

When the second tray 380 move from the water supply position to the ice making position, the water in the space between the first tray 320 and the second tray 380 may be uniformly distributed to the plurality of first cells 320*b*.

When water passages are provided in the first tray 320 and/or the second tray 380, ice made in the ice making cell 320*a* may also be made in a portion of the water passage.

In this case, when the controller of the refrigerator controls one or more of the cooling power of the cold air supply part 900 and the heating amount of the transparent ice heater to vary according to the mass per unit height of the water in the ice making cell 320*a*, one or more of the cooling power of the cold air supply part 900 and the heating amount of the transparent ice heater may be abruptly changed several times or more in the portion at which the water passage is provided.

This is because the mass per unit height of the water increases more than several times in the portion at which the water passage is provided. In this case, reliability problems of components may occur, and expensive components having large maximum output and minimum output ranges may be used, which may be disadvantageous in terms of power consumption and component costs. As a result, the present invention may require the technique related to the aforementioned ice making position to make the transparent ice.

Figure 7:
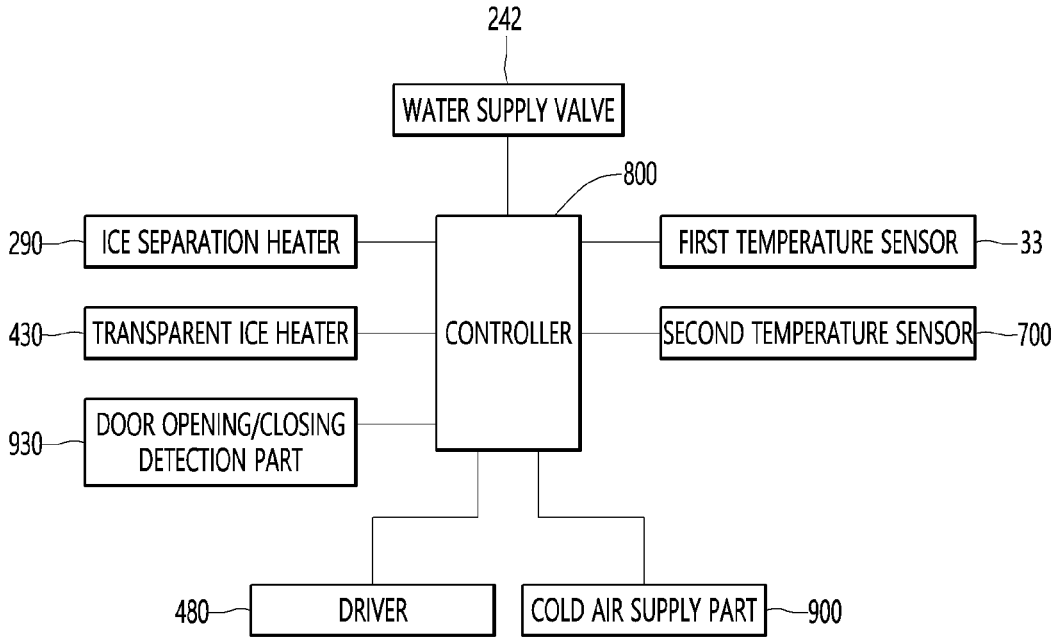
FIG. 7 is a control block diagram of a refrigerator according to an embodiment of the present invention.

FIG. 7 is a control block diagram of the refrigerator according to an embodiment.

Referring to FIG. 7, the refrigerator according to this embodiment may include an air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The refrigerator according to this embodiment may further include a controller 800 that controls the cold air supply part 900.

Also, the refrigerator may further include a water supply valve 242 controlling an amount of water supplied through the water supply part 240.

The refrigerator may further include a door opening/closing detection part 930 for detecting an opening/closing of a door of a storage chamber (for example, the freezing compartment 32) in which the ice maker 200 is installed.

The controller 800 may control a portion or all of the ice separation heater 290, the transparent ice heater 430, the driver 480, the cold air supply part 900, and the water supply valve 242.

When the door opening/closing detection part 930 detects the opening/closing of the door (a state in which the door is opened and closed), the controller 800 may determine whether cooling power of the cold air supply part 900 is variable.

When the door opening/closing detection part 930 detects the opening/closing of the door, the controller 800 determines whether an output of the transparent ice heater 430 is variable based on a temperature detected by the second temperature sensor 700.

In this embodiment, when the ice maker 200 includes both the ice separation heater 290 and the transparent ice heater 430, the output of the ice separation heater 290 and the output of the transparent ice heater 430 may be different from each other.

When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented. Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or an internal temperature sensor) that senses a temperature of the freezing compartment 32. The controller 800 may control the cold air supply part 900 based on the temperature sensed by the first temperature sensor 33.

The controller 800 may determine whether the ice making is completed based on the temperature sensed by the second temperature sensor 700.

Figure 8:
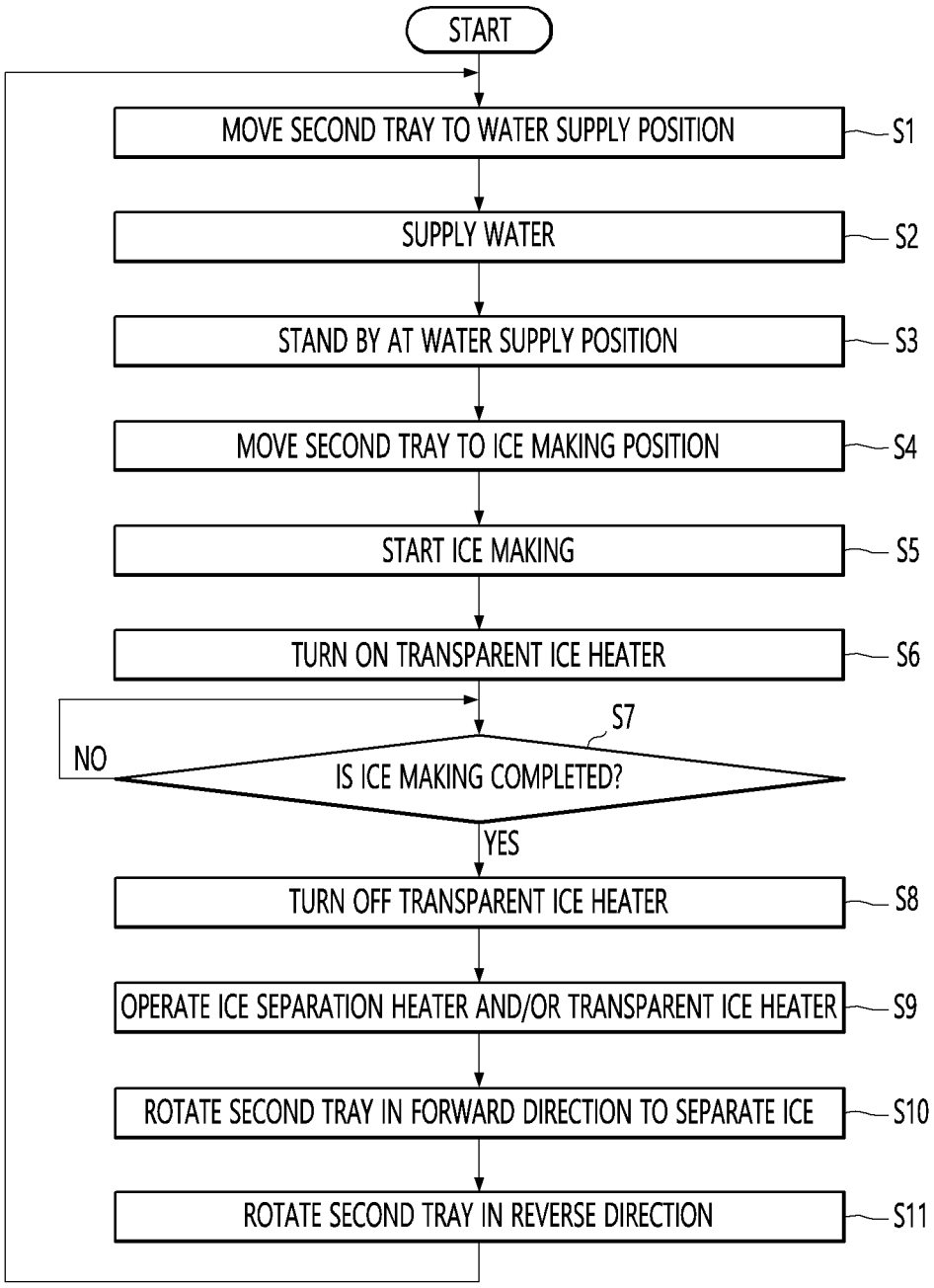
FIG. 8 is a flowchart for explaining a process of making ice in the ice maker according to an embodiment of the present invention.

FIG. 8 is a flowchart for explaining a process of making ice in the ice maker according to an embodiment.

Figure 10:
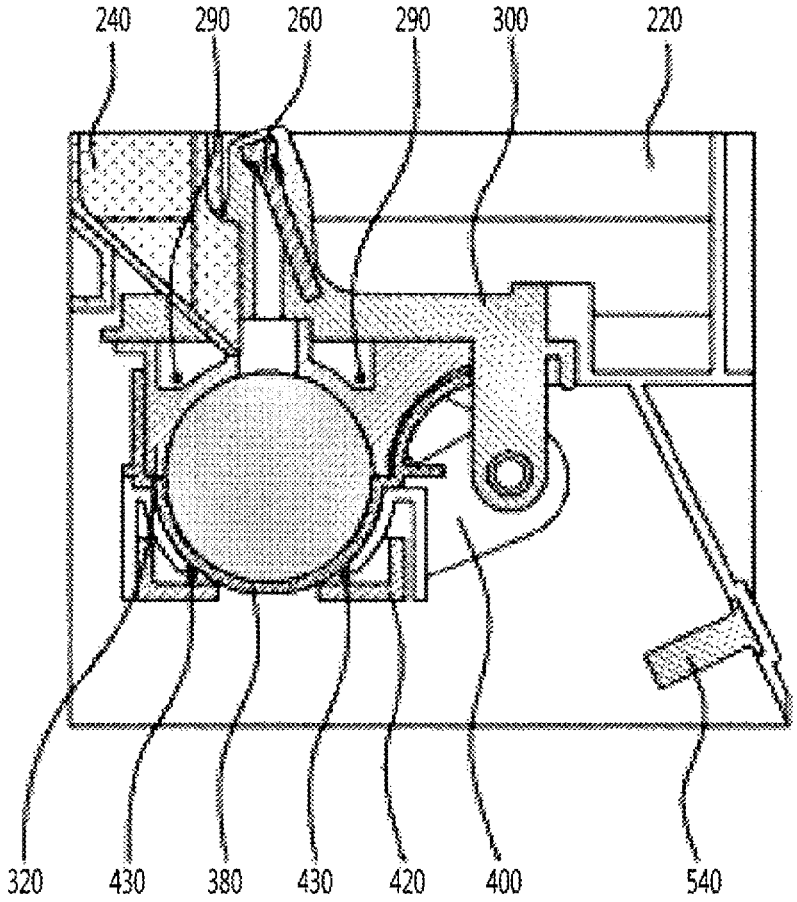
FIG. 10 is a view illustrating a state in which ice is generated at an ice making position.
Figure 11:
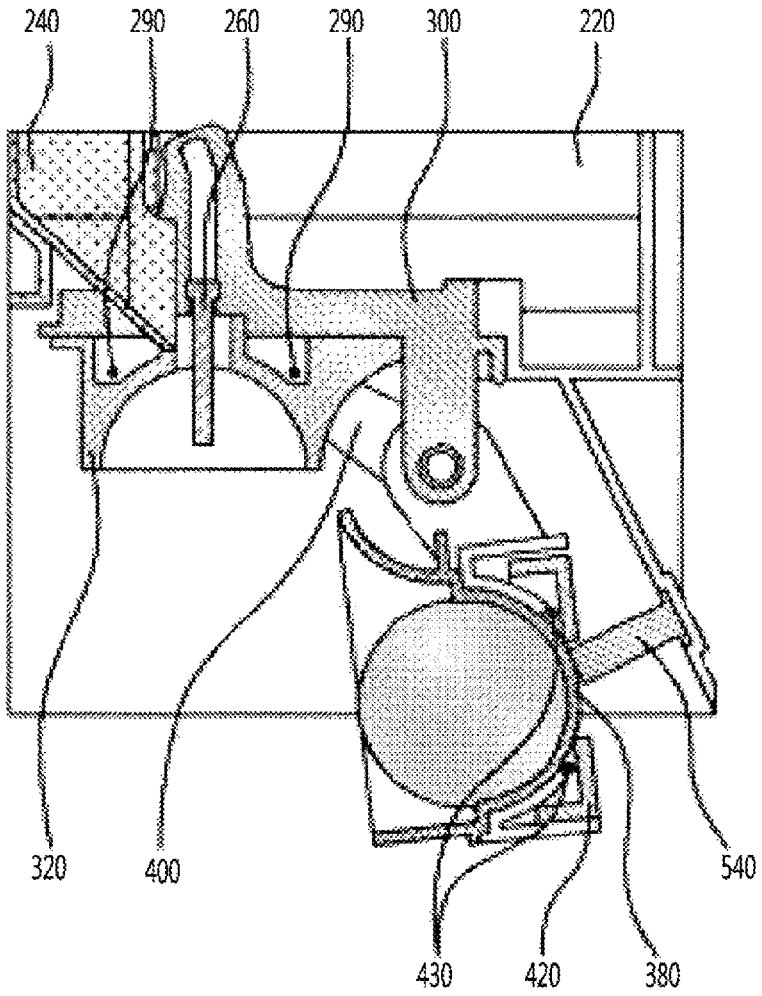
FIG. 11 is a view illustrating a state in which a second tray and a first tray are separated from each other in an ice separation process.
Figure 12:
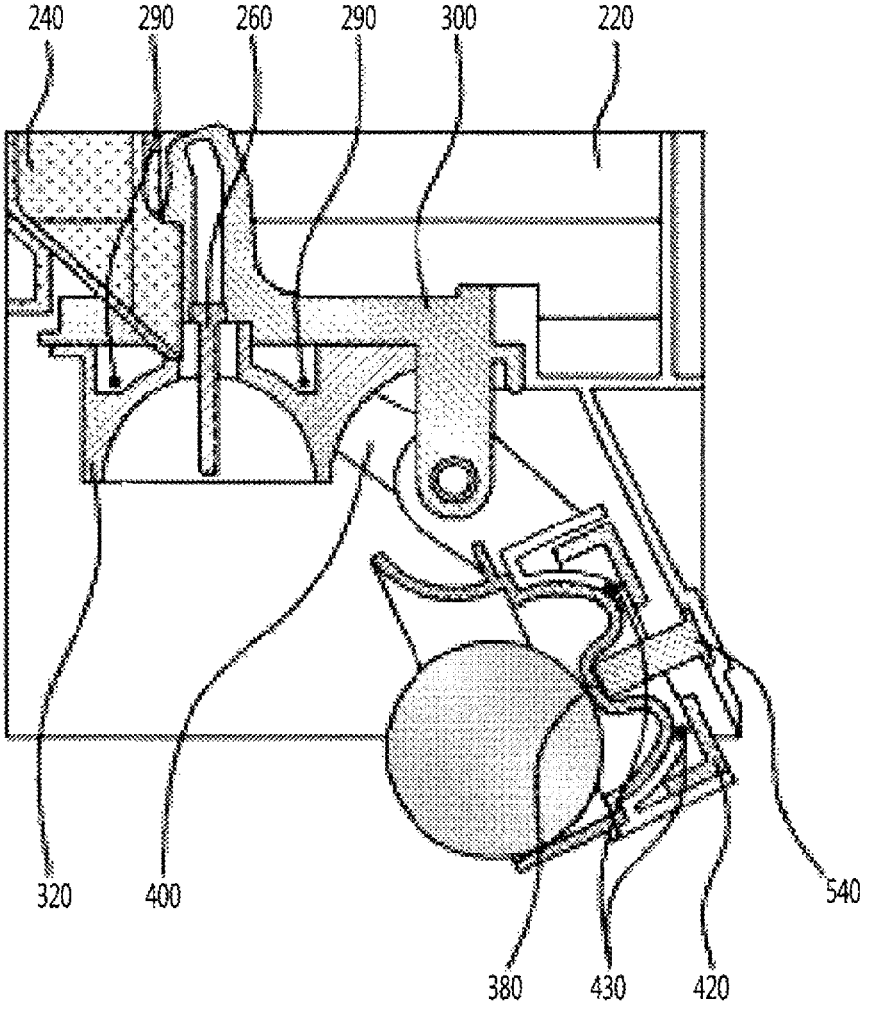
FIG. 12 is a view illustrating a state in which a second tray moves to an ice separation position in the ice separation process.

FIG. 9 is a view illustrating a state in which the water supply is completed, FIG. 10 is a view illustrating a state in which ice is generated at the ice making position, FIG. 11 is a view illustrating a state in which the second tray and the first tray are separated from each other in an ice separation process, and FIG. 12 is a view illustrating a state in which the second tray moves to the ice separation position in the ice separation process.

Referring to FIGS. 8 to 12, to make ice in the ice maker 200, the controller 800 moves the second tray 380 to a water supply position (S1).

In this specification, a direction in which the second tray 380 moves from the ice making position of FIG. 10 to the ice separation position of FIG. 12 may be referred to as forward movement (or forward rotation). On the other hand, the direction from the ice separation position of FIG. 12 to the water supply position of FIG. 6 may be referred to as reverse movement (or reverse rotation).

The movement to the water supply position of the second tray 380 is detected by a sensor, and when it is detected that the second tray 380 moves to the water supply position, the controller 800 stops the driver 480.

In the state in which the second tray 380 moves to the water supply position, the water supply starts (S2). For the water supply, the controller 800 turns on the water supply valve 242, and when it is determined that a predetermined amount of water is supplied, the controller 800 may turn off the water supply valve 242. For example, in the process of supplying water, when a pulse is outputted from a flow sensor (not shown), and the outputted pulse reaches a reference pulse, it may be determined that a predetermined amount of water is supplied.

After the water supply is completed, it is possible to stand by for a predetermined time to spread water evenly in the ice making cell 320*a* (S3).

This is done for preventing a phenomenon in which water is concentrated in one ice making cell 320*a*, to which water is supplied, as the water supply proceeds in one of the plurality of ice making cells 320*a*. The predetermined time may be sufficient time to uniformly distribute water to the plurality of ice making cells 320*a*.

After the water supply is completed, the controller 800 controls the driver 480 to allow the second tray 380 to move to the ice making position (S4). For example, the controller 800 may control the driver 480 to allow the second tray 380 to move from the water supply position in the reverse direction.

When the second tray 380 move in the reverse direction, the top surface 381*a* of the second tray 380 comes close to the bottom surface 321*e* of the first tray 320. Then, water between the top surface 381*a* of the second tray 380 and the bottom surface 321*e* of the first tray 320 is divided into each of the plurality of second cells 320*c* and then is distributed. When the top surface 381*a* of the second tray 380 and the bottom surface 321*e* of the first tray 320 contact each other, water is filled in the first cell 320*b*.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S5). For example, the ice making may be started when the second tray 380 reaches the ice making position. Alternatively, when the second tray 380 reaches the ice making position, and the water supply time elapses, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a* (S6).

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied.

In this embodiment, the transparent ice heater 430 is not turned on immediately after the ice making is started, and the transparent ice heater 430 may be turned on only when the turn-on condition of the transparent ice heater 430 is satisfied.

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature detected by the second temperature sensor 700 reaches a turn-on reference temperature.

For example, the turn-on reference temperature may be a temperature for determining that water starts to freeze at the uppermost side (communication hole-side) of the ice making cell 320*a*. When a portion of the water is frozen in the ice making cell 320*a*, the temperature of the ice in the ice making cell 320*a* is below zero. The temperature of the first tray 320 may be higher than the temperature of the ice in the ice making cell 320*a*.

Alternatively, although water exists in the ice making cell 320*a*, after the ice starts to be made in the ice making cell 320*a*, the temperature detected by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may be convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the controller 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and the turn-off time of the transparent ice heater 430 in one cycle, or a ratio of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

Since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

The output of the transparent ice heater 430 is gradually reduced from the first section to the intermediate section after the transparent ice heater 430 is turned on.

The output of the transparent ice heater 430 may be minimum in the intermediate section in which the mass of unit height of water is minimum. The output of the transparent ice heater 430 may again increase step by step from the next section of the intermediate section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

Even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may increase step by step.

The cooling power of the cold air supply part 900 may be maximum in the intermediate section in which the mass per unit height of water is maximum. The cooling power of the cold air supply part 900 may be reduced again step by step from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water. The heating power may be inversely proportional to the mass per unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature detected by the second temperature sensor 700 (S7). When it is determined that the ice making is completed, the controller 800 may turn off the transparent ice heater 430 (S8).

For example, when the temperature detected by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature detected by the second temperature sensor 700 reaches a second reference temperature lower than the first reference temperature.

When the ice making is completed, the controller 800 operates at least one or more of the ice maker heater 290 and the transparent ice heater 430 (S9).

When the ice separation heater 290 is turned on, heat of the ice separation heater 290 may be transferred to the first tray 320, and thus, the ice may be separated from a surface (an inner surface) of the first tray 320.

Also, the heat of the ice separation heater 290 is transferred to a contact surface between the first tray 320 and the second tray 380, and thus, the bottom surface 321*d* of the first tray and the top surface 381*a* of the second tray 380 may be in a state capable of being separated from each other.

After at least one or more of the ice separation heater 290 and the transparent ice heater 430 are turned on, when the moving condition of the second tray 380 is satisfied, the controller 800 may turn off the heater that is turned on and may rotate the second tray 380 in the forward direction so that the second tray 380 moves to the ice separation position (S10).

As illustrated in FIG. 11, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, the ice may be separated from the surface of the first tray 320 by the heat of the ice separation heater 290. In this case, the ice may move together with the second tray 380 while the ice is supported by the second tray 380.

As another example, the ice may not be separated from the surface of the first tray 320 even by the primary and secondary heating of the ice separation heater 290.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* may press the ice contacting the first tray 320, and thus, the ice may be separated from the tray 320. The ice separated from the first tray 320 may be supported by the second tray 380.

When the ice moves together with the second tray 380 while the ice is supported by the second tray 380, the ice may be separated from the tray 250 by its own weight even if no external force is applied to the second tray 380.

While the second tray 380 moves, even if the ice does not drop from the second tray 380 by its own weight, when the second tray 380 is pressed by the second pusher 540 as illustrated in FIG. 12, the ice may be separated from the second tray 380 to drop downward.

Particularly, as illustrated in FIG. 11, while the second tray 380 moves, the second tray 380 may contact the extension part 544 of the second pusher 540.

When the second tray 380 continuously moves in the forward direction, the extension part 544 may press the second tray 380 to deform the second tray 380 and the extension part 544. Thus, the pressing force of the extension part 544 may be transferred to the ice so that the ice is separated from the surface of the second tray 380. The ice separated from the surface of the second tray 380 may drop downward and be stored in the ice bin 600.

In this embodiment, as shown in FIG. 12, the position at which the second tray 380 is pressed by the second pusher 540 and deformed may be referred to as an ice separation position. The ice making position, the water supply position, and the ice separation position may alternatively be referred to as a first position, a second position, and a third position.

In this embodiment, ice may be separated from the tray through two heating processes of the ice separation heater 290 and the first and second pushers in order to secure the ice separation reliability.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the ice state.

After the ice is separated from the second tray 380, the controller 800 controls the driver 480 to allow the second tray 380 to move in the reverse direction (S11). Then, the second tray 380 moves from the ice separation position to the water supply position.

When the second tray 380 moves to the water supply position of FIG. 6, the controller 800 stops the driver 480 (S1).

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

In this embodiment, the cooling power of the cold air supply part 900 may be determined corresponding to a target temperature of the freezing compartment 32. The cold air generated by the cold air supply part 900 may be supplied to the freezing chamber 32.

The water of the ice making cell 320*a* may be phase-changed into ice by heat transfer between the cold water supplied to the freezing chamber 32 and the water of the ice making cell 320*a*.

In this embodiment, a heating amount of the transparent ice heater 430 for each unit height of water may be determined in consideration of predetermined cooling power of the cold air supply part 900.

A heating amount (or output) of the transparent ice heater 430 determined in consideration of the predetermined cooling power of the cold air supply part 900 is referred to as a reference heating amount (or reference output). The magnitude of the reference heating amount per unit height of water is different.

However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, a case in which the heat transfer amount of cold air and water is reduced may be, for example, a case in which the cooling power of the cold air supply pat 900 is reduced, a case in which the door is opened, and air having a temperature higher than the temperature of the cold air in the freezing compartment 32 is supplied to the freezing compartment 32, a case in which food having a temperature higher than the temperature of cold air in the freezing compartment 32 is put into the freezing compartment 32, or a case a defrost heater (not shown) for defrosting of the evaporator is turned on.

For example, a target temperature of the freezing compartment 32 is lowered, an operation mode of the freezing compartment 32 is changed from a normal mode to a rapid cooling mode, an output of at least one of the compressor or the fan increases, or an opening degree increases, the cooling power of the cold air supply part 900 may increase.

On the other hand, the target temperature of the freezer compartment 32 increases, the operation mode of the freezing compartment 32 is changed from the rapid cooling mode to the normal mode, the output of at least one of the compressor or the fan decreases, or the opening degree of the refrigerant valve decreases, the cooling power of the cold air supply part 900 may decrease.

When the heat transfer amount of cold air and water increases, the temperature of the cold air around the ice maker 200 decreases to increase in rate of ice generation.

On the other hand, if the cooling power of the cold air supply part 900 decreases, the temperature of the cold air around the ice maker 200 increases, the ice making rate decreases, and also, the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

Figure 13:
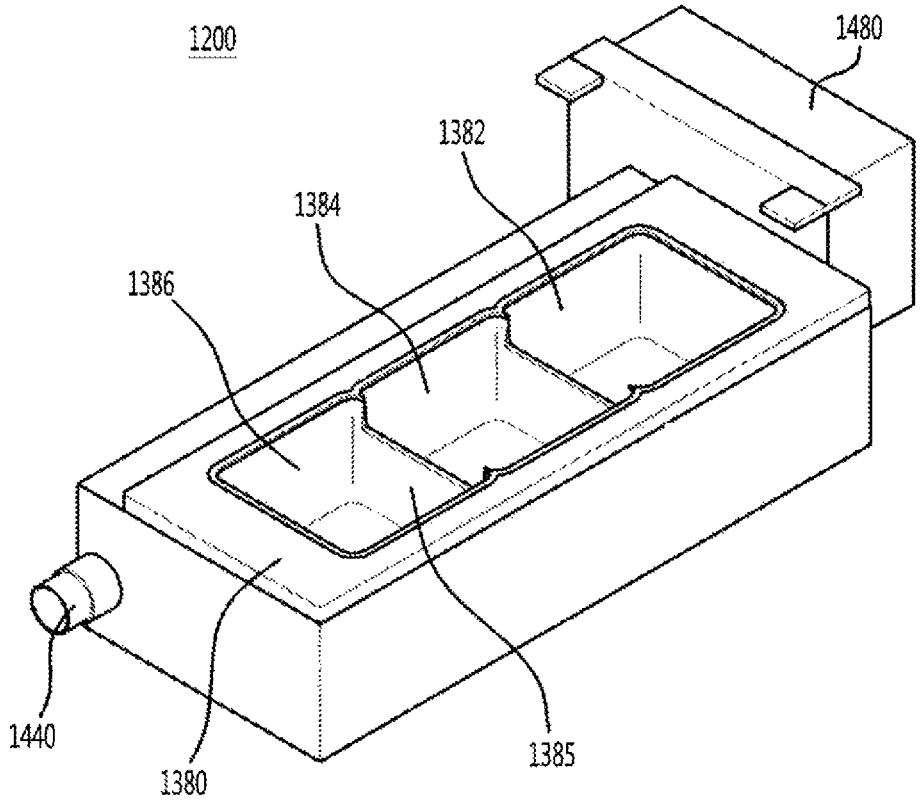
FIG. 13 is a view of another ice maker according to another embodiment.
Figure 14:
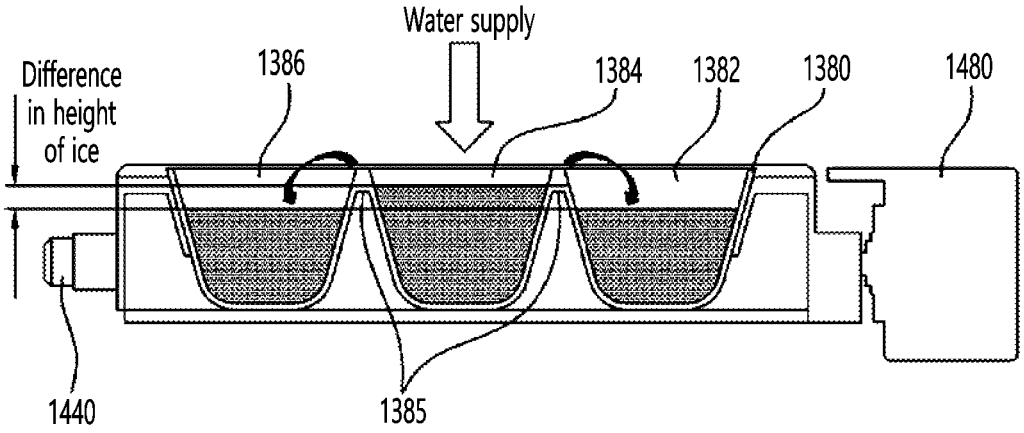
FIG. 14 is a view illustrating a water supply process according to another embodiment.

FIG. 13 is a view of another ice maker according to another embodiment, and FIG. 14 is a view illustrating a water supply process according to another embodiment.

Referring to FIGS. 13 and 14, ice making cells 1382, 1384, and 1386 through which a plurality of ice are individually frozen may be formed in a tray 1380 according to another embodiment.

The ice making cells are separated from each other by a partition wall 1385, and the partition wall 1385 has a height lower than that of an edge formed outside the tray 1380.

Since the tray 1380 is connected to a rotation shaft 1440 of a motor part 1480, the tray 1380 may rotate as the rotation shaft 1440 rotate.

The partition wall 1385 is disposed so that an upper end thereof is flat and horizontal, and a passage such as a separate water valley for branching water into the ice making cells 1382, 1384, and 1386 is not formed in the upper end of the partition wall 1385. The partition wall 1385 performs the same function as a wall that separates the ice making cells from each other.

Water is supplied from the tray 1380 having a plurality of ice making cells 1382, 1384, and 1386 without the separate water valley to the central ice making cell 1384. Here, the supplied water moves to the surrounding ice making cells 1382 and 1386, and only when a water level exceeds a height of the partition wall 1385, the water may move to another cell.

In this case, water having different water levels is supplied to the central ice making cell 1384 and the ice making cells 1382 and 1386 that are disposed at both sides. This is because only water that overflows the central ice making cell 1384 may move to another ice making cell disposed therearound. That is, water having a different water level is supplied to each ice making cell, and thus, a specific ice making cell is maintained in the same water level as a height of the partition wall based on the height of the partition wall 1385, and other ice making cells are maintained to a water level lower than the height of the partition wall.

Then, the height of ice generated in the central ice making cell 1384 is the same as the height of the partition wall 1385, and ice generated in the surrounding ice making cell has a height lower than that of the partition wall 1385. Accordingly, since the made ice has two or more heights, ice having various heights may be provided to the user. Since the generated ice has a shape depending on a shape of each of the ice making cells, if the shapes of the ice making cells are the same, ice having only different heights may be provided to the user.

Figure 15:
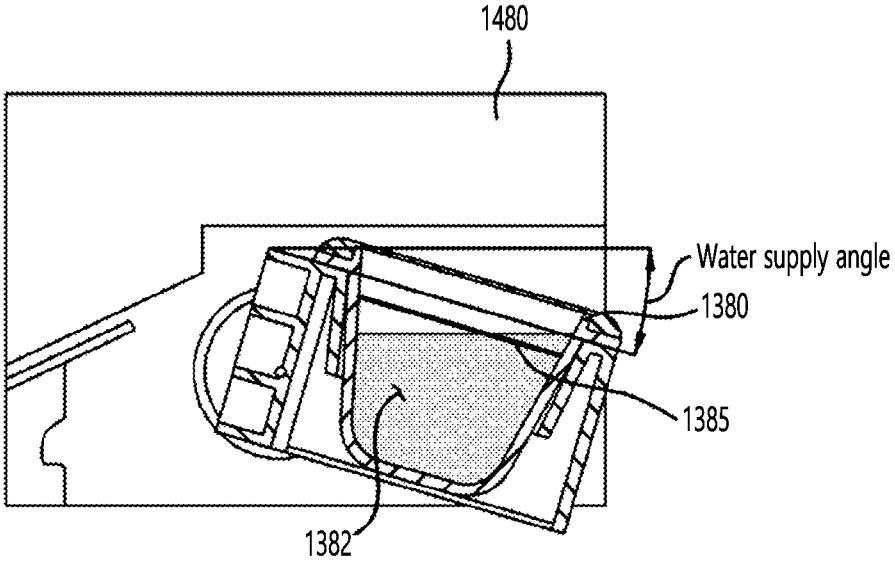
FIG. 15 is a view illustrating a water supply process according to further another embodiment.
Figure 15:
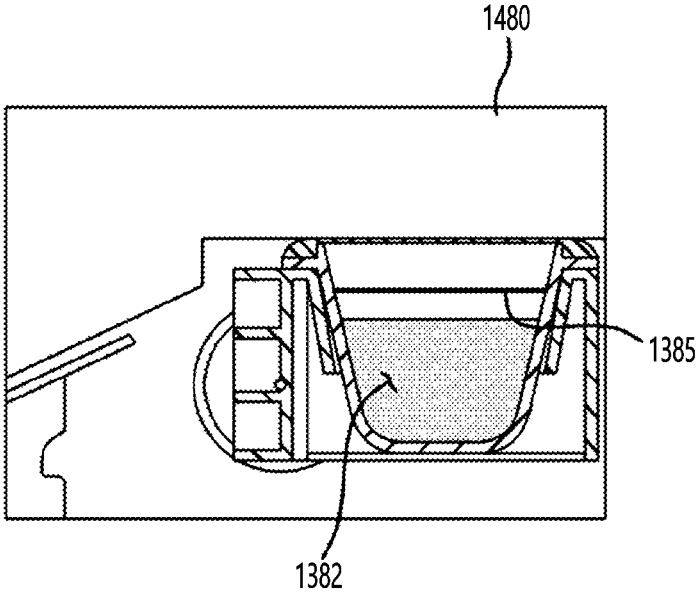

FIG. 15 is a view illustrating a water supply process according to further another embodiment.

View (a) of FIG. 15 is a diagram illustrating a state in which the tray 1380 is inclined at a predetermined angle while water is supplied to the tray, and view (b) of FIG. 15 is a view illustrating a state in which the tray returns to its original position so that a surface of the water is horizontal to generate ice after water is supplied.

As illustrated in view (a) of FIG. 15, water is supplied so as not to overflow the outer periphery of the tray 1380 while the tray 1380 rotates. Here, the water supply valve 740 supplies water so that water does not overflow in consideration of a height and capacity of the outer periphery of the tray 1380. At this time, an amount of supplied water may also vary depending on the angle at which the tray 1380 rotates.

When water is supplied, the tray 1380 rotates at a predetermined water supply angle. At this time, when water is supplied to any one of the ice making cells 1382, 1384, and 1386, the water supply angle is selected so that the water level rises above the height of the partition wall 1385. Also, the water supply angle is calculated so that water does not overflow to the outside of the tray 1380 when water is supplied.

As illustrated in view (a) of FIG. 15, in a state in which the tray 1380 rotates at the water supply angle for a predetermined time for which the water spreading from the ice making cell 1382, to which water is supplied, to the other surrounding ice making cells is completed, the tray stands by.

After a predetermined time elapses, the tray 1380 returns to the ice making position for the ice making, as illustrated in view (b) of FIG. 15. Here, the water level of each ice-making cell is maintained below the height of the partition wall, so that the ice making cells 1382, 1384, and 1386 are not connected to each other by water, and ice separated from each other in each of the ice making cells may be generated.

The partition wall 1385 is a fixed wall provided on the tray 1380 as illustrated in FIG. 13. Thus, when the tray 1380 rotates, the partition wall 1385 is also inclined, and one end of the partition wall 1385 decreases in height, whereas the other end of the partition wall 1385 increases in height. Water may be distributed to each ice-making cell through the lowered portion of the partition wall 1385.

Therefore, even in the present embodiment, after supplying water to one ice making cell, there is no need to provide the water valley, which is a passage through which water moves to different ice making cells, and thus water valley marks are not left on the ice.

The invention claimed is:

1. A refrigerator comprising:

a storage chamber;

a cold air supply configured to supply cold air; and an ice maker comprising:

a first tray configured to define a first portion of a cell;

a second tray configured to define a second portion of the cell, the first and second portions configured to form a space in which a liquid introduced into the space is phase changed to ice;

a tray case configured to support the second tray;

a tray cover configured to surround the second tray;

a liquid supply configured to supply the liquid to the cell;

a driver configured to move the second tray relative to the first tray to a first position, a second position, and a third position; and a controller configured to control the driver such that:

after the liquid has been supplied to the space of the cell, the second tray is moved to the first position so that an ice making process is performed while the second tray is provided at the first position;

after the ice making process is completed such that the liquid in the space has been phase-changed to ice, the second tray is moved in a first direction to the third position; and after the ice is separated from the second tray at the third position, the second tray is moved from the third position to the second position in a second direction, the second direction being a direction opposite to the first direction and the second position being a position between the first and third positions, wherein the first tray includes a first straight portion and a first curved portion, wherein the second tray includes a cell wall to define the second portion of the cell, and a circumferential wall extended from the cell wall and configured to surround a portion of the first tray when the second tray is at the second position, wherein the circumferential wall includes a second straight portion and a second curved portion, wherein the second straight portion faces the first straight portion and the second curved portion faces the first curved portion when the second tray is at the first position, and the tray cover is configured to surround an outer surface of the second straight portion and the second curved portion.

2. The refrigerator of claim 1, wherein the second tray is provided below the first tray, and at the second position, the first portion of the cell is disposed between the second straight portion and the second curved portion.

3. The refrigerator of claim 2, wherein, at the second position, a height from a bottom surface of the first tray to an upper end of the circumferential wall is greater than ½ of a height from the bottom surface of the first tray to an upper end of the cell.

4. The refrigerator of claim 1, wherein the first tray includes an opening to introduce the liquid into the cell, and the second tray is provided below the first tray, and at the first position, an upper end of the circumferential wall is provided higher than the opening of the first tray.

5. The refrigerator of claim 1, wherein, at the second position, a bottom surface of the first tray and a top surface of the second tray are inclined at a predetermined angle with respect to each other.

6. The refrigerator of claim 5, wherein the predetermined angle ranges from 4 degrees to 30 degrees.

7. The refrigerator of claim 6, wherein the predetermined angle ranges from 4 degrees to 8 degrees.

8. The refrigerator of claim 1, further comprising a heater provided to supply heat into the cell, wherein the controller is configured to control the heater to be turned on during the ice making process so that air bubbles dissolved in the liquid within the space of the cell move from where ice is being generated toward where the liquid is still in a liquid state.

9. The refrigerator of claim 1, further comprising a heater provided to supply heat into the cell, wherein at least one of a cooling power of the cold air supply or a heating amount of the heater varies according to a volume per unit height of the liquid in the space of the cell.

10. A refrigerator, comprising:

a storage chamber;

a cold air supply configured to supply cold air; and an ice maker comprising:

a first tray configured to define a first portion of at least one cell;

a second tray provided below the first tray and configured to define a second portion of the at least one cell, the first and second portions configured to form at least one space in which a liquid introduced into the space is phase changed to ice;

a tray case configured to support the second tray;

a tray cover configured to surround the second tray;

a liquid supply configured to supply the liquid to the at least one cell;

a heater provided to supply heat into the at least one cell;

a driver, wherein the second tray is a moveable tray which is configured to move, via the driver, to a first position, a second position, and a third position; and a controller configured to control the driver and the heater such that:

after the liquid has been supplied to the space of the at least one cell, the moveable tray is moved to the first position so that an ice making process is performed while the moveable tray is provided at the first position;

after the ice making process is completed such that the liquid in the space has been phase-changed to ice, the moveable tray is moved in a first direction to the third position; and after the ice is separated from the moveable tray at the third position, the moveable tray is moved from the third position to the second position in a second direction, the second direction being a direction opposite to the first direction and the second position being a position between the first position and the third position, wherein the first tray includes a first straight portion and a first curved portion, wherein the second tray includes a cell wall to define the second portion of the at least one cell, and a circumferential wall extended from the cell wall and configured to surround a portion of the first tray when the second tray is at the second position, the first tray includes an opening to introduce the liquid into the at least one cell, and the second tray is provided below the first tray, wherein the circumferential wall includes a second straight portion and a second curved portion, and wherein the second straight portion faces the first straight portion and the second curved portion faces the first curved portion when the second tray is at the first position, when the second tray is at the second position, a height from a bottom surface of the first tray to an upper end of the second curved portion is greater than ½ of a height from the bottom surface of the first tray to an upper end of the at least one cell.

11. The refrigerator of claim 10, wherein the first portion of the at least one cell is disposed between the second straight portion and the second curved portion at the second position.

12. The refrigerator of claim 10, wherein, at the second position, the moveable tray is rotated by a predetermined angle to be inclined.

13. The refrigerator of claim 10, wherein the at least one cell includes a plurality of cells.

14. The refrigerator of claim 13, wherein the first and second trays are configured such that, in the second position, when the liquid is supplied to one cell among the plurality of cells, the liquid is distributed to the other cells among the plurality of cells.

15. The refrigerator of claim 14, wherein a partition wall is provided between adjacent second portions of the second tray, and the partition wall has a height that is lower than an upper surface of the second tray.

16. The refrigerator of claim 10, wherein the heater is configured such that the heater turns on in the ice making process.

17. An ice maker, comprising:

a first tray configured to define a first portion of a cell;

a second tray provided below the first tray and configured to define a second portion of the cell, the first and second portions configured to form a space in which a liquid introduced into the space is phase changed to ice;

a liquid supply configured to supply the liquid to the cell;

a heater provided to supply heat into the cell;

a driver, wherein the second tray is a moveable tray which is configured to move, via the driver; and a controller configured to control the driver and the heater, wherein the second tray includes a cell wall to define the second portion of the cell, and a circumferential wall extended from the cell wall and configured to surround a portion of the first tray when the second tray is at the first an ice making position, the first tray includes an opening to introduce the liquid into the cell, the heater comprises an ice separation heater in contact with the first tray, and wherein the first tray includes a first straight portion and a first curved portion, the circumferential wall includes a second straight portion and a second curved portion, and the second straight portion faces the first straight portion and the second curved portion faces the first curved portion when the second tray is at the ice making position.

18. The ice maker of claim 17, wherein the first portion of the cell is disposed between the second straight portion and the second curved portion when the second tray is at a liquid supply position.

19. The ice maker of claim 17, wherein the liquid supply overlaps the opening of the first tray in a vertical direction.

* * * * *